US005595291A

United States Patent [19]

Negelen

[11] Patent Number: 5,595,291

[45] Date of Patent: Jan. 21, 1997

[54] CONTAINER FOR ARTICLES

[75] Inventor: Emanuel Negelen, Schweich, Germany

[73] Assignee: Riverwood International Limited, Bristol, United Kingdom

[21] Appl. No.: 374,621

[22] PCT Filed: Jul. 14, 1993

[86] PCT No.: PCT/GB93/01481

§ 371 Date: Mar. 13, 1995

§ 102(e) Date: Mar. 13, 1995

[87] PCT Pub. No.: WO94/02380

PCT Pub. Date: Feb. 3, 1994

[30] Foreign Application Priority Data

Jul. 17, 1992 [GB] United Kingdom ..... 9215257

[51] Int. Cl.[6] ..... B65D 71/00

[52] U.S. Cl. ..... 206/143; 206/162

[58] Field of Search ..... 206/427, 139, 206/162, 168, 167, 193, 194, 197, 199, 169, 170, 174, 175, 176, 177, 142, 143

[56] References Cited

U.S. PATENT DOCUMENTS

| | | | |
|---|---|---|---|
| 4,256,626 | 3/1981 | Stone | 206/427 |
| 4,341,309 | 7/1982 | Oliff | 206/429 |
| 5,158,177 | 10/1992 | Negelen et al. | 206/147 |
| 5,167,325 | 12/1992 | Sykora | 206/162 X |
| 5,351,815 | 10/1994 | Fogle et al. | 206/162 X |
| 5,400,901 | 3/1995 | Harrelson | 206/162 X |

FOREIGN PATENT DOCUMENTS

| | | |
|---|---|---|
| 0122397 | 2/1984 | European Pat. Off. . |
| 0396301 | 11/1990 | European Pat. Off. . |
| 2700158 | 7/1978 | Germany . |
| 27570095 | 7/1979 | Germany . |

*Primary Examiner*—Jacob K. Ackun
*Attorney, Agent, or Firm*—Hopkins & Thomas

[57] ABSTRACT

There is provided a basket type container 11 having a handle portion 12 for carrying a plurality of bottles 14. The container 11 has side walls 18 and end panels 24, 25. There are also retention panels 15 extending between the side walls 18 and the handle portion 12 for holding the bottles in the container 11 and preventing removal. Lines of weakening may be provided to disable the retention panels 15 and allow access to the bottles 14.

17 Claims, 4 Drawing Sheets

CONTAINER FOR ARTICLES

FIELD OF THE INVENTION

This invention relates to a container for articles, which container is known generally as a 'basket-type' container.

BACKGROUND OF THE INVENTION

Basket type containers are well known and generally comprise an open topped basket portion in which articles such as bottles sit. There is also provided a handle portion for carrying the container complete with articles. It is very common for the articles to be beverage bottles containing beer for example. The basket type container constitutes a convenient method of carrying a number of bottles. Commonly the container containers 6 bottles in two rows of three but other configurations are used such as 2×2, 1×3, 2×4, etc.

One significant drawback with known basket type containers is that customers can take single bottles from the container. This causes difficulties when the pricing system prices the whole arrangement of articles rather than individual bottles. Also of course it is easy to steal individual bottles from a retail outlet. In addition careless transporting can result in the articles falling out of the container if say the container is inadvertently tipped onto its side or upside down.

SUMMARY OF THE INVENTION

According to a first aspect of the present invention there is provided a basket type paperboard container for a plurality of articles, the container comprising a handle portion, a basket portion having a bottom wall, two oppositely disposed side walls and two oppositely disposed end walls, and retaining means for retaining the articles in the basket portion, said retaining means having one or more areas which have an initial, article retaining position and which have an opened position whereby the area or areas have been removed or partially removed to allow removal of the articles, the handle portion and basket portion remaining substantially in tact after said removal or partial removal of said one or more areas.

Preferably said retaining means comprises portions which extend generally from each side wall towards the handle portion. Ideally said portions are extensions of said side walls and co-operate to constitute at least part of said handle portion.

In some embodiments the or each of said areas is marked on the extensions but it is preferred that the or each area is defined by lines of weakening such as perforations or cuts.

One preferred feature is that the extensions incorporate openings each for receiving the top of an article, one opening per article. In some arrangements the basket portion is adapted to receive two rows of articles, such that each article has an associated opening.

In certain arrangements a line of weakening connects the lower part of the end holes on each extension and extends below any other holes. Preferably the parts of each extension at the extreme lengthwise ends, wide of the openings is reinforced, ideally by a double thickness of paperboard.

Conveniently the handle portion is formed by gluing the top sections of the extensions. It is stronger if each top is double thickness by virtue of a folded-in portion. It is also best if said top margins of the extensions incorporate holes for providing a handhold.

A preferred feature is that the end wall is constituted by one or more panels hingedly connected to at least one of the side walls. In one arrangement each end wall is constituted by two panels attached to respective side walls and joined together. Preferably the end portion of each end panel of one end wall is hingedly connected to its associated end panel, folded inwards and adhesively attached to the adjacent and portion of the associated end panel.

In some forms the end portions are adapted to define individual compartments for each article by utilising partially cut out portions, folds and adhesive.

The bottom wall may comprise one or more bottom panels hingedly attached to one or more of said side walls. Conveniently the bottom wall comprises two panels attached to respective side walls and adhesively attached to each other.

According to a second aspect of the present invention there is provided a blank for producing such containers.

Embodiments of the present invention will now be described in more detail. The description makes reference to the accompanying diagrammatic drawings in which:

DETAILED DESCRIPTION

Figure 2:
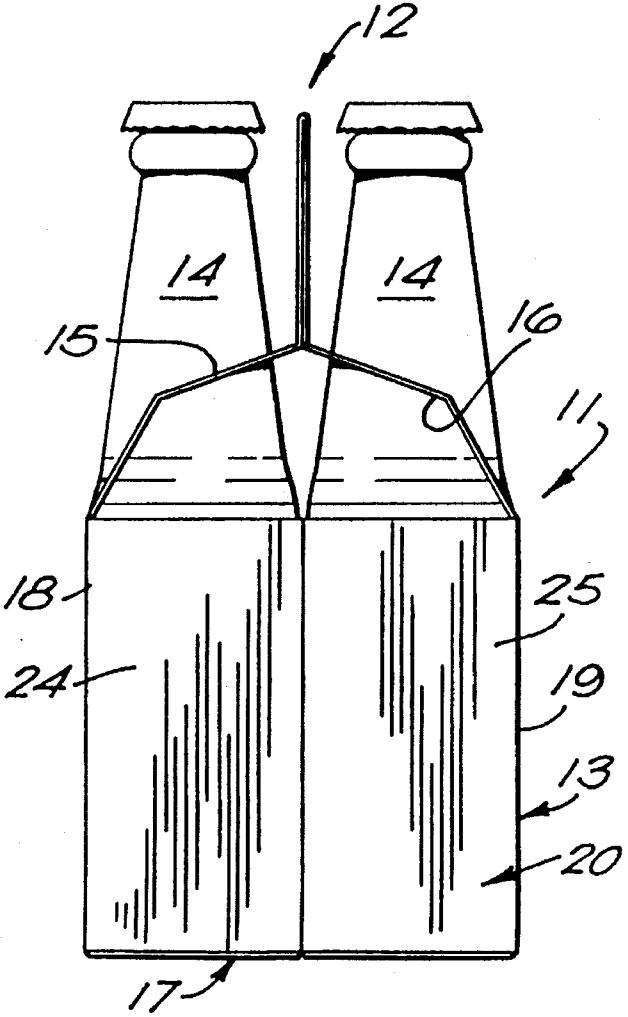
FIG. 2 is an end view of the arrangement shown in FIG. 1.
Figure 1:
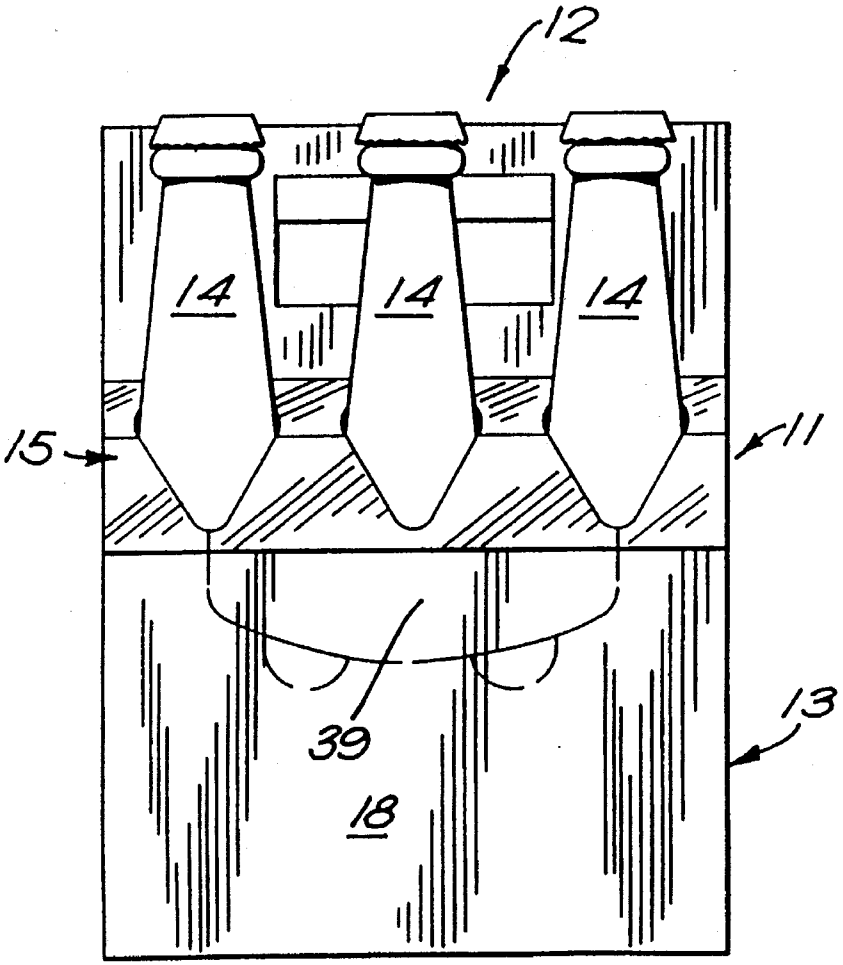
FIG. 1 is a side view of a container arrangement according to the present invention.
Figure 3:
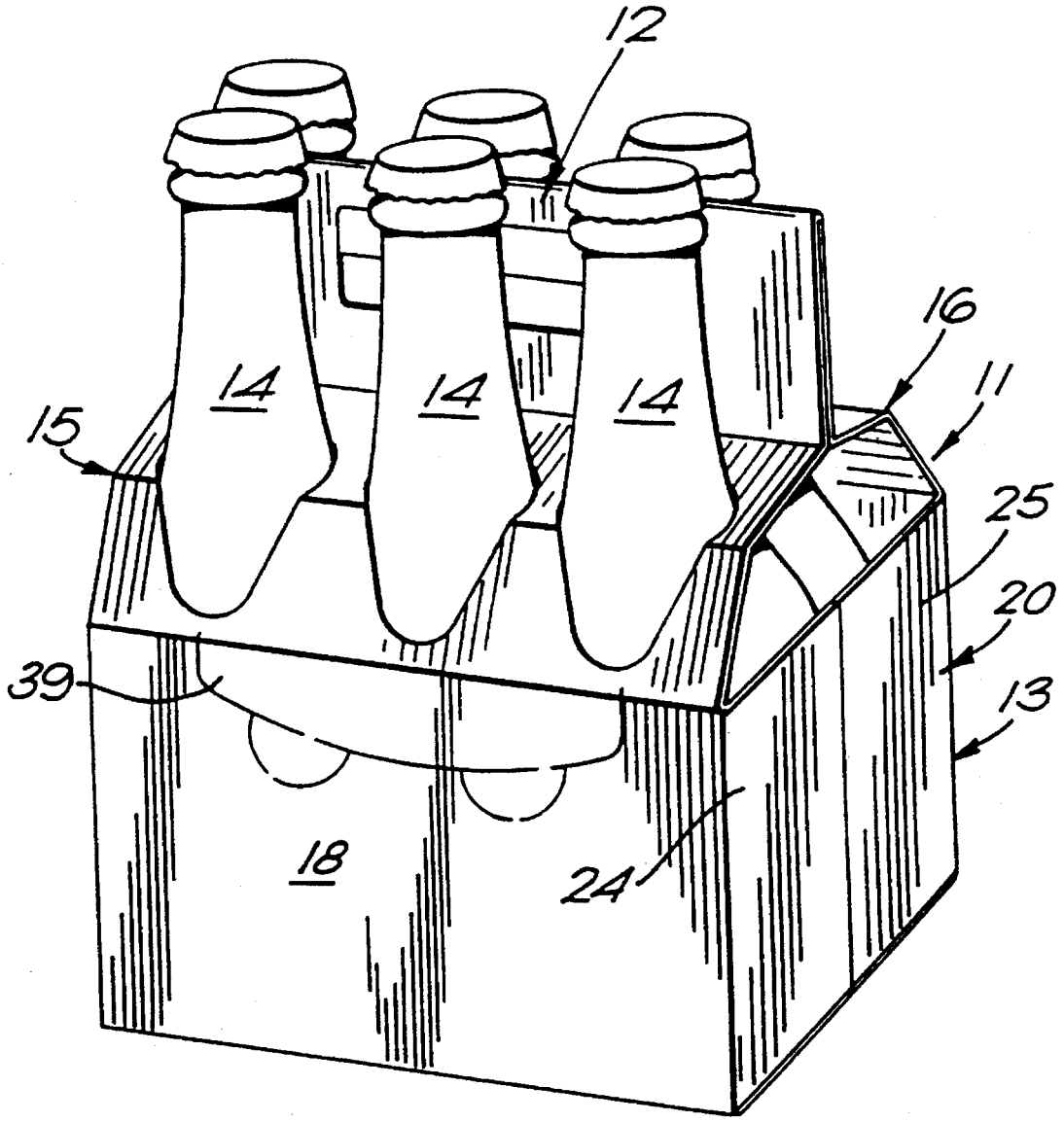
FIG. 3 is a perspective view of the arrangement shown in FIG. 1.

Referring to FIGS. 1 to 4, FIG. 4 shows a paperboard blank 10 for producing a container 11 shown in FIGS. 1 to 3. The container 11 generally has a handle portion 12, a basket portion 13 in which sit bottles 14 and two retention portions 15, 16 for retaining the bottles 14 in the basket portion 13.

The basket portion 13 has a bottom wall 17, a pair of oppositely disposed side walls 18, 19 and a pair of oppositely disposed end walls 20, 21. The bottom wall 17 is made up of two bottom panels 22, 23 which are hingedly connected to the respective side walls 18, 19 and which are secured together during manufacture of the container using adhesive.

Each end wall 20, 21 comprises a pair of end panels 24, 25 which are hingedly connected to the respective side walls. The panels 24, 25 have hingedly connected end flaps 26 which in manufacture of the carton are bent inwardly and secured to each other using adhesive. In the embodiment shown, where there are to be two rows of three bottles 14, these secured end flaps 26 can provide a division between the rows depending of course on the length of the flaps 26.

The retention portions 15, 16 comprise extensions 27, 28 of the side walls 18, 19 and are hingedly connected thereto. The extensions 27, 28 have openings 29 through which the caps and necks of the bottles 14 extend although the openings 29 are not large enough for the whole bottles 14 to pass through. Reinforcing panels 30 at the extreme edges of the extensions 27, 28 are folded inwards and adhered to the inside of the extensions 27, 28 wide of the end openings 29. These panels 30 provide extra strength for reasons which will become apparent. In each extension 27, 28 a partial cut 31 extends between the lower end of the end openings 29, passing below the middle opening 29. Finger sections 32 are provided at two locations on each cut 31.

The extensions 27, 28 are hingedly connected to handle panels 33, 34 which in turn are hingedly connected to each other along central fold line 35. The panels 33, 34 each have a hole 36 formed therein midway along their length. These holes 36 constitute a handhold in the finished container 11. Laterally of the panels 33, 34 are hingedly connected reinforcement sections 37 having cutouts 38. During manufacture, the sections 37 are folded in below the panels 33, 34 and adhesively secured thereto, with the cutouts 38 fitting aground the holes 36. The combined panels 33, 34 and reinforcements are then folded about the centre fold 35 and adhesively secured to each other to form the handle portion 12. In most places the handle portion is four layers of paperboard thick so as to safely carry the weight of six bottles in this example.

When the container 11 is assembled around the bottles 14 it will be appreciated that none of the bottles 14 can be removed from the container. It is the extensions 27, 28 which provide this element of security which may give rise to the term pilferproof container or tamper-evident container.

To gain access to the bottles it is necessary to break open the container using partial cuts 31 and finger sections 32 for ease of opening. Opening up cuts 31 means that the bottles 14 can now be removed. The flaps 39 produced by this opening can then be pushed back inwards and held there by replacing the empty bottles in the basket portion 13. The container 11 is therefore a convenient means for buying the bottles and also for returning the bottles or carrying them to a recycling location. The container itself can also be deposited for recycling as well as the empty bottles.

It will be appreciated that the reinforcing panels 30 ensure that the handle portion 12 remains securely attached to the basket portion 13 after the flaps 39 have been pulled open. The need for the reinforcement is of course largely dependent on the strength of the basic paperboard and the weight that has to be carried.

Figure 4:
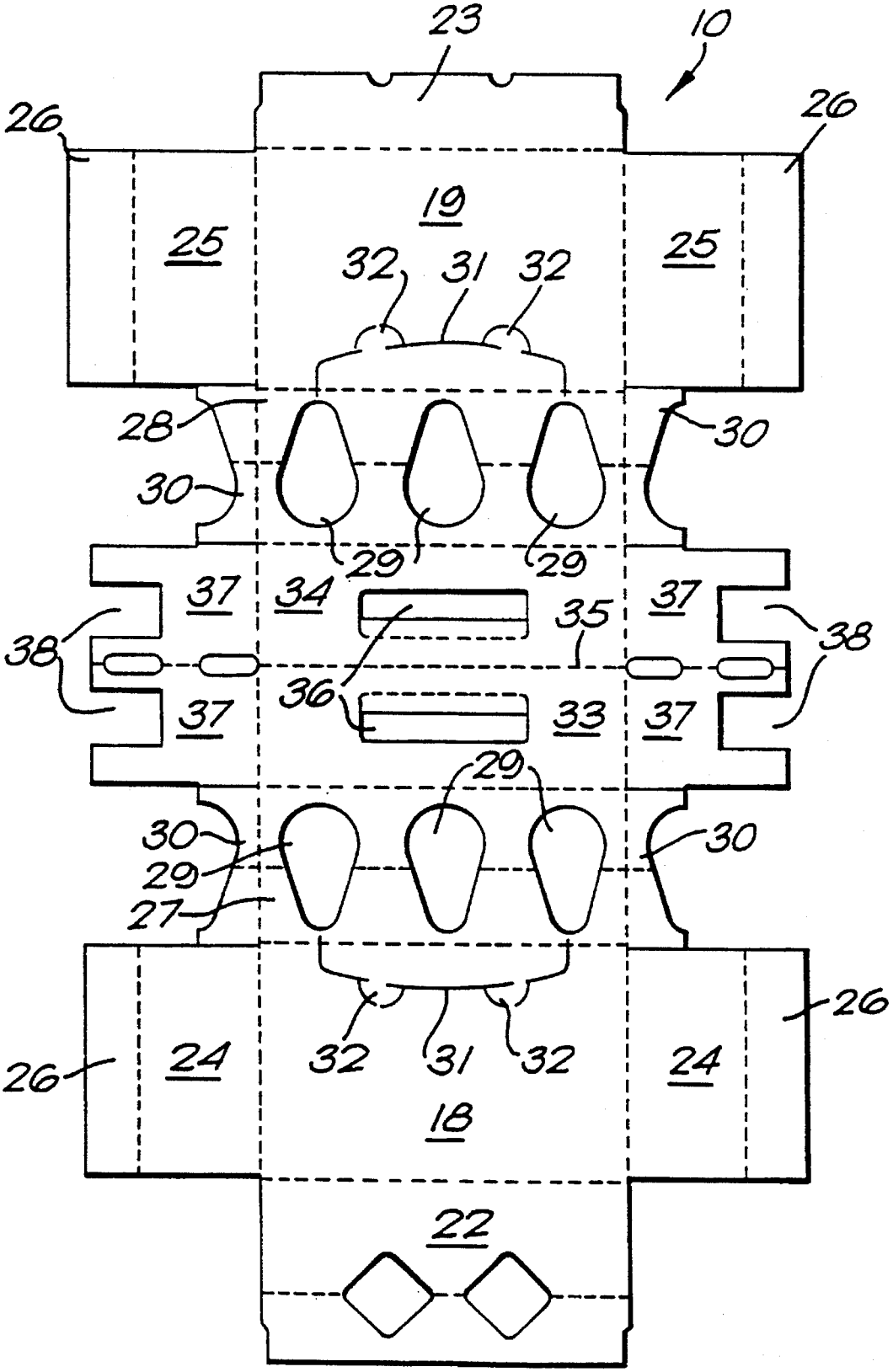
FIG. 4 is a blank for producing the arrangement shown in FIG. 1.
Figure 5:
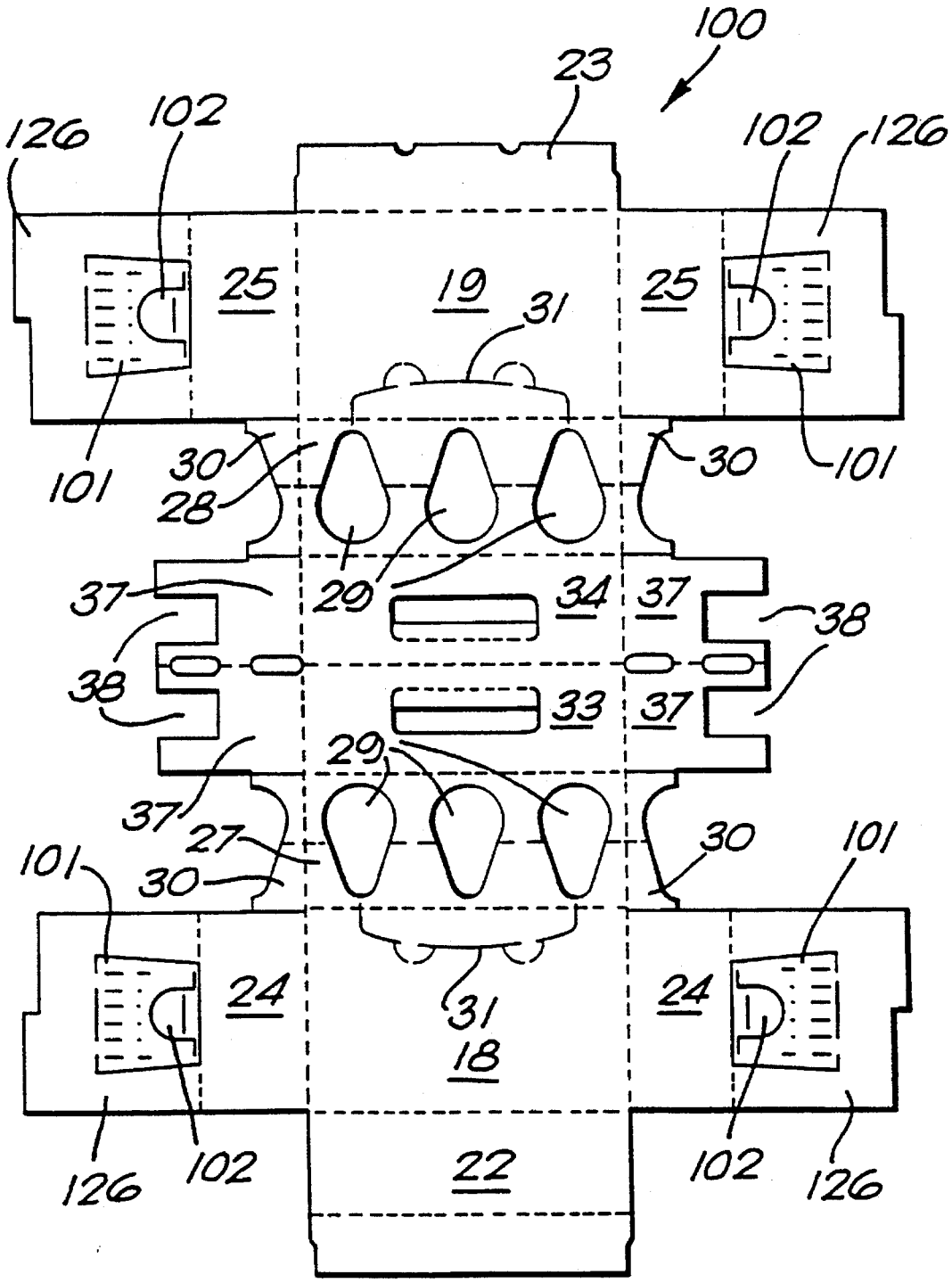
FIG. 5 is a blank for producing a further arrangement according to the-present invention.

The blank 100 shown in FIG. 5 is almost identical to that shown in FIG. 4 and so like parts have been given like-reference numerals. The difference is that in blank 100 the flaps 126 are longer, being at least half the length of the side walls 18, 19. These flaps 126 are all adhesively secured to each other and form a full central dividing wall for the container. Each flap 126 has a sub-panel 101 which is hingedly connected to its associated flap 126 and in manufacture is bent at 90° to the associate flap 126. Each sub-panel 101 has a hinged tab 102 which is adhesively secured to the inside of the side walls 18, 19. It will be appreciated that this produces a container in which there are individual bottle compartments to prevent glass to glass contact.

There are of course many variations which will be apparent to the skilled person. Obviously the number of bottles and indeed rows are variable. The bottles may for example be in staggered rows such that the bottles in one row partially nestle between bottles in an adjacent row. This can give rise to configurations such as a 2,3 container or a 3,2,3 container. This can result in more compact containers.

The geometry and number of opening flaps could also be readily changed and it is not strictly necessary to provide lines of weakening such as the partial cuts 31. Instructions to cut using scissors or a knife may be printed on the container.

Clearly the container provides extra space for advertising or other writing or graphic information. Also the actual configuration of the blank can be varied as would be clear to the skilled person.

The retaining means may also be formed by a separate element utilising a separate blank which is adhered to the basic basket. The retaining means can also be formed without openings 29 such that they extend right over any articles in the basket.

I claim:

1. A basket type paperboard container for a plurality of articles, the container comprising a handle portion, a basket portion having a bottom wall, two oppositely disposed side walls and two oppositely disposed end walls, and retaining means for retaining the articles in the basket portion, said retaining means having one or more areas which have an initial, article retaining position and which have an open position whereby the area or areas have been removed or partially removed to allow removal of the articles, and reinforcing means for reinforcing said retaining means in a region outside said one or more areas, the handle portion and basket portion remaining substantially intact after said removal or partial removal of said one or more areas.

2. A basket type paperboard container as claimed in claim 1 wherein said retaining means comprises portions which extend generally from each side wall towards the handle portion.

3. A basket type paperboard container as claimed in claim 2 wherein said portions are extensions of said side walls and co-operate to constitute at least part of said handle portion.

4. A basket type paperboard container as claimed in claim 3 wherein each of said areas is marked on said extensions.

5. A basket type paperboard container as claimed in claim 1 wherein each area is defined by lines of weakening.

6. A basket type paperboard container as claimed in claim 3 wherein the openings are formed in the extensions, one opening per article.

7. A basket type paperboard container as claimed in claim 6 wherein the basket portion is adapted to receive two rows of articles, such that each article has an associated opening.

8. A basket type paperboard container as claimed in claim 6 wherein a line of weakening connects the lower part of end openings on each extension and extends below any other openings.

9. A basket type paperboard container as claimed in claim 3 wherein said handle portion is formed by gluing the top sections of the extensions.

10. A basket type paperboard container as claimed in claim 9 wherein each top is double thickness by virtue of a folded-in portion.

11. A basket type paperboard container as claimed in claim 9 wherein said top margins of the extensions incorporate holes for providing a handhold.

12. A basket type paperboard container as claimed in claim 1 wherein each end wall is constituted by one or more panels hingedly connected to at least one of said side walls.

13. A basket type paperboard container as claimed in claim 12 wherein each end wall is constituted by two panels attached to respective side walls and joined together.

14. A basket type paperboard container as claimed in claim 13 wherein an end portion of each end panel of one end wall is hingedly connected to its associated end panel, folded inwards and adhesively attached to the adjacent end portion of the associated end panel.

15. A basket type paperboard container as claimed in claim 14 wherein the end portions are adapted to define individual compartments for each article by utilising partially cut out portions, folds and adhesive.

16. A blank for forming a basket type paperboard container as claimed in claim 1.

17. A basket type paperboard container as claimed in claim 1 and where in said reinforcing means comprises an adhered double thickness of paperboard.

* * * * *